US005149569A

United States Patent [19]

McCue

[11] Patent Number: 5,149,569

[45] Date of Patent: Sep. 22, 1992

[54] BASE MEMBER FOR PROTECTIVE STRIP ASSEMBLY

[75] Inventor: David S. McCue, Marblehead, Mass.

[73] Assignee: McCue Corporation, Danvers, Mass.

[21] Appl. No.: 649,440

[22] Filed: Feb. 1, 1991

Related U.S. Application Data

[63] Continuation-in-part of Ser. No. 478,540, Feb. 12, 1990, Pat. No. 5,096,753.

[51] Int. Cl.[5] ..... E04F 19/02; B60J 11/00

[52] U.S. Cl. ..... 428/31; 428/99; 428/100; 52/288; 52/718.1; 24/297; 293/126; 293/128

[58] Field of Search ..... 428/99, 100, 31; 24/292-297, 291; 52/717.1, 288, 718.1; 293/126, 128

[56] References Cited

U.S. PATENT DOCUMENTS

| | | | |
|---|---|---|---|
| 2,487,571 | 11/1949 | Maxwell | 16/5 |
| 3,889,320 | 6/1975 | Koscik | 24/73 |
| 4,066,285 | 10/1978 | Hall et al. | 293/62 |
| 4,072,334 | 2/1978 | Seegmiller et al. | 293/71 |
| 4,083,592 | 4/1978 | Rueben et al. | 293/71 |
| 4,161,853 | 7/1979 | Weiss et al. | 428/100 |
| 4,808,451 | 2/1989 | McCue et al. | 428/31 |
| 4,911,971 | 3/1990 | McCue et al. | 428/99 |

*Primary Examiner*—Alexander S. Thomas
*Attorney, Agent, or Firm*—Lahive & Cockfield

[57] ABSTRACT

Disclosed is a protective strip assembly for use in protecting walls, cabinets, display stands, and the like from impact by shopping carts and the like in retail outlets. The assembly comprises an elongate base member and an overfitting protective trim member held together by opposed interlocking ridges and notches. The overfitting protective trim member absorbs shock as opposed leg members resiliently spread transversely to the axis of the strip assembly at interfitting sliding surfaces. The base member includes downwardly extending side walls. The base member further includes support members which occupy a space formed between the mounting surface and trim connector portion.

12 Claims, 5 Drawing Sheets

BASE MEMBER FOR PROTECTIVE STRIP ASSEMBLY

RELATED PATENTS

This application is a continuation-in-part of U.S. Ser. No. 478,540 which was filed on Feb. 12, 1990 now U.S. Pat. No. 5,096,753.

BACKGROUND OF THE INVENTION

This invention relates to protective strip assemblies, particularly to base members for strip assemblies for protecting walls and the edges and corners of display cases, display stands, and the like from impact by shopping carts in supermarkets.

Protective strip assemblies using resilient strip materials in various types of channels are known in the art, as illustrated in U.S. Pat. No. 4,808,451 and references cited therein. In that patent, a metal channel is capped by a strip of resilient deformable material designed to absorb the force of impact. The ends of the resilient strip lie flush with the surface to be protected. In existing assemblies, the resilient strip is manufactured from deformable-type material, such as rubber or plasticized "flex" vinyl, which, depending upon use, may wear from constant deformation.

"Flex" vinyl, as generally used for protective strips, shrinks over time and with wear. The shrinkage decreases the effective surface area for absorbing shock and providing protection. In addition, such "flex" vinyl is manufactured from a variety of plasticizers and fillers of indeterminate quality.

Such protective strip assemblies may be mounted on a base member. The base member most commonly serves as a mounting element for mounting the strip assemblies to a wall or other structure to be protected. Base members of presently available protective strip assemblies generally provide neither additional structural support nor protection to the surface upon which it is mounted.

It is an object of the invention to provide a protective strip assembly which is durable, easy to clean, and has a relatively long lifespan. Another object is to provide a protective strip assembly which is relatively easy to assemble and which can be installed in close proximity to intersecting walls, or in multiple parallel arrays.

It is a further object of the invention to provide a base member for a protective strip assembly which provides structural support and additional protection to the surface upon which the assembly is mounted.

These and other objects and features of the invention will be apparent from the description, drawings, and claims which follow.

SUMMARY OF THE INVENTION

The protective strip assembly comprises an elongate base member having a longitudinal axis and an overfitting protective trim member.

The base member generally comprises at least one mounting surface and means for attaching the base member to a wall or other surface to be protected. The base member further includes trim connector portion spaced apart from the mounting surfaces. The connector portion includes an opposing pair of latch elements, with an inwardly angled first latch wall extending from each of the elements. Each latch element is substantially transverse to and extends along the longitudinal axis. The base member also includes a web-like structure which has a plurality of support members extending transverse to the longitudinal axis, and which may extend from the mounting element to the trim connector portion. The base member has a side wall downwardly extending from each of the first latch walls, each side wall. In one embodiment, the side walls comprise an upper, concave portion and a lower, convex portion.

The protective trim member interlocks with the base member at the trim connector portion. The trim member includes an elongate top portion which extends along a longitudinal axis and which is connected to a pair of opposed leg members which are resiliently spreadable transverse to the axis. Each of the leg members terminate in a latch ridge for interfitting with each of the latch elements of the base member.

In operation, force such as a bump on the top portion of the trim member in a direction transverse to the longitudinal axis causes the trim member to slide downwardly along the side wall thereby to absorb the force. Thus, due to the space between the trim connector portion and the mounting surface, the trim portion does not come in contact with the surface to be protected.

Each latch element connecting the first and second latch walls further may comprise an acutely inwardly angled latch flange defining a second sliding surface extending along the longitudinal axis. Also, the latch elements may be inwardly resiliently deformable. With this embodiment, the opposed pair of first sliding surfaces of the trim leg members during assembly, upon the application of force to the trim member, slide downwardly transversely along the second sliding surface to interfit each of the latch ridges with each of the corresponding latch notches.

The mounting surface may intersect the first latch wall, and may have a plurality of grooves extending along the longitudinal axis which deform to conform with a wall when the assembly is mounted. The mounting surface may also include a plurality of spurs which project from the bottom of the base member to form the mounting surface, thus creating spacing between the mounting surface and the bottom of the base member.

The base member may further define a pair of elongate opposed clefts, each of which defines a portion of an inner wall of the latch elements to permit easier inward deformation thereof. The base member and the trim member may comprise a substantially rigid material, such as a rigid polymeric or metallic material. For example, both sections may be produced as extrusions.

The assembly may further comprise corner connectors for providing a continuous band of protective strip around corners. End caps may be included in the assembly to provide protection at terminal portions of the assembly. Since several assemblies may be interconnected, a seam support element may be included to Provide support to the protective trim member at the seams.

BRIEF DESCRIPTION OF THE DRAWINGS

The foregoing and other objects of this invention, the various features thereof, as well as the invention itself, may be more fully understood from the following description, when read together with the accompanying drawings, in which.

Like reference characters in the respective drawn figures indicate corresponding parts.

DESCRIPTION

Figure 1:
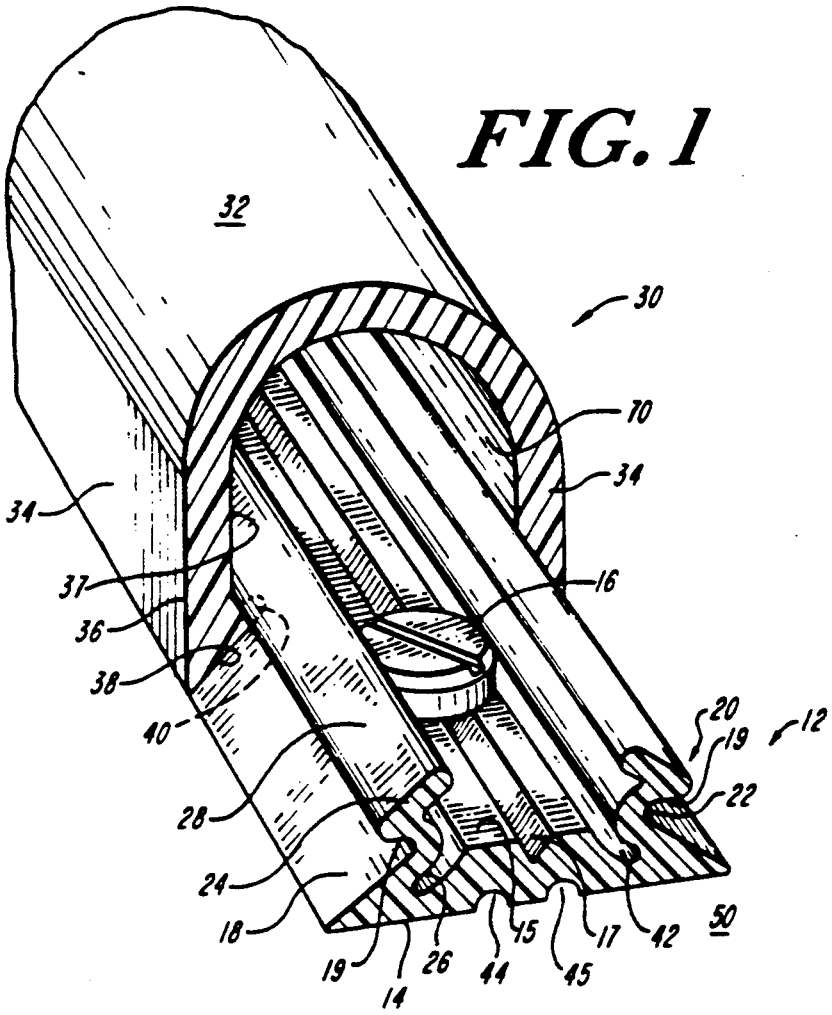
FIG. 1 is a perspective, partly broken away view of one embodiment of the protective strip assembly of the invention.

As shown generally in FIG. 1, the protective strip assembly 10 of the invention comprises an elongate base member 12 interfitted with a protective trim member 30. The entire assembly is attached to a wall 50 or other surface, usually a vertical surface, for protecting the wall against damage due to bumping or striking. The assembly may be fixed horizontally along a wall, display stand, freezer compartment, counter or the like in a supermarket or other retail outlet where shopping carts or the like are used. One advantage of the protective strip assembly of the invention is that it may be installed directly against structures abutting its sides, or may be installed in parallel, mutually abutting arrays. Of course, the structure may be adapted or used as is for protection in other contexts.

The base member 12 comprises an attachment means 16, an internal groove surface 15, and a mounting surface 14. The attachment means 16 may be a screw, nail or other conventional fastener, or may comprise a film of adhesive. The internal groove surface 15 may have a guiding groove 17 for guiding and receiving the attachment means 16. The mounting surface 14 is in direct contact with a wall 50 to which the assembly 10 is mounted. The mounting surface 14 may be substantially planar, or may be shaped to conform with a particular shape of the wall 50; for example, the rounded or angular edge of a grocery display case. The mounting surface may also have a groove 44 or multiple grooves 44, 45 which flex and deform to conform to the surface of the wall 50 to which the assembly 10 is mounted.

In the illustrated embodiment of FIG. 1, an opposing pair of acutely, inwardly angled first latch walls 18 extend along parallel to the longitudinal axis of base member 12. These walls are angled to enable sliding contact with the protective strip 30 as discussed hereafter. The first latch walls 18 are attached to outwardly angled second latch walls 19 by opposing latch elements 20. The junctions of the first latch walls 18 with second latch walls 19 define latch notches 22. The latch notches 22 may be angular, rounded, or squared. The notches should be of sufficient depth to permit interlocking ridges 40 on trim member 30 to be securely engaged therein.

Figure 2:
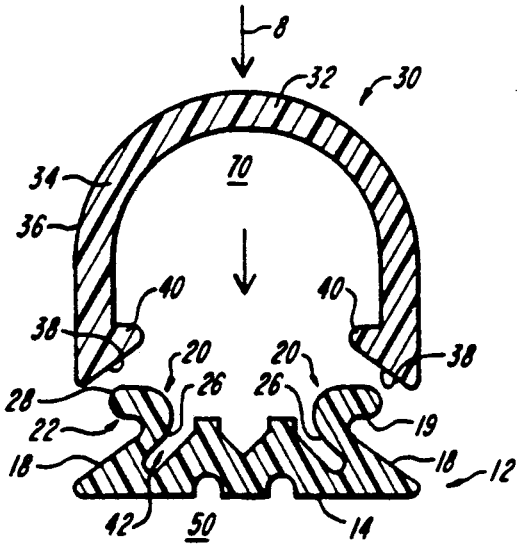
FIGS. 2 and 3 are cross-section exploded views of the trim connector portion of the embodiment of FIG. 1 shown before (FIG. 2) and after (FIG. 3) the base member and trim member are interfitted.
Figure 3:
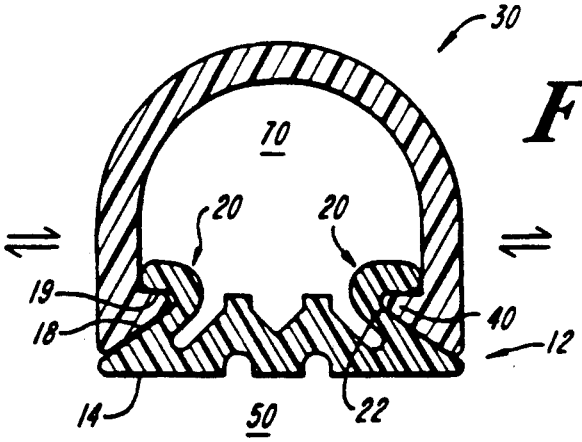

As best shown in FIGS. 2 and 3, the side of each latch element 20 opposite the first latch wall 18 may comprise a rear latch element wall 26 and a cleft 42 disposed in the base member 12. The clefts 42 provide additional space for the latch elements 20 to move inwardly in response to any downward pressure which may be exerted in the course of installation or use of the assembly 10. Atop each latch element 20 are elongate flanges 24 defining second sliding surfaces 28 disposed at an angle transverse to the central axis. Pressure exerted toward wall 50 by a first sliding surface 38 of trim member 30 onto second sliding surface 28 can serve to inwardly, resiliently flex the latch elements 20 to permit engagement of the trim member 30 to base 12 during installation as disclosed below.

The protective trim member 30, in operative form, is interlocked with the base member 12 as shown in FIGS. 1 and 3. The trim member 30 generally comprises a top portion 32 which will receive impacts when the assembly 10 is in use. Extending downwardly from opposite sides of the top portion 32 are an opposing pair of leg members 34, each terminating in a first sliding surface 38 and a latch ridge 40. In the preferred aspect of the invention, the trim member 30 is generally arcuate in shape, and is raised above the base member 12 to form a cavity 70 between the two members. This cavity allows for some resilience in the trim member 30 in response to pressure exerted thereupon. The trim member 30 may of course take other shapes, e.g., may be substantially square, polyhedral, or polygonal.

Each leg member 34 defines opposed outer 36 and inner 37 leg walls, and terminates in a first sliding surface 38 which extends upwardly and inwardly from the outer leg wall 36. The plane of this first sliding surface 38 generally corresponds to the plane of the first latch wall 18 to enable the first sliding surface 38 to move slidably transversely along the surface of the first latch wall 18. A latch ridge 40 is defined at the end of the first sliding surface 38 and is dimensioned to interfit and interlock with the latch notch 22.

The protective trim member 30 is manufactured from a resilient, non-deformable, typically polymeric or metallic material, such as rigid polyvinyl chloride or aluminum. The top portion 32 may be substantially rigid, while the leg members 34 have sufficient resilience to absorb impacts by literally spreading.

To install the protective strip assembly, the base member 12 is fixed to a surface to be protected by means of adhesive, fasteners, etc., and the protective trim member 30 is interfitted with the base member 12, as illustrated in FIGS. 1 and 3.

As illustrated in FIG. 2, by positioning the first sliding surface 38 of each leg 34 upon the second sliding surface 28 of each latch element 20, and applying downward pressure on the top portion 32, in the direction of arrow 8, each latch ridge 40 is interfitted with its corresponding latch notch 22 in the direction of arrow 8. This arrangement enables the installer to position multiple strip assemblies 10 next to each other, or abutting other structures, as the leg members need not spread beyond the lateral edge of base member 12 to be latched in place. Instead, latch elements 20 deform inwardly to permit latching of the ridge in the notch.

Figure 4A:
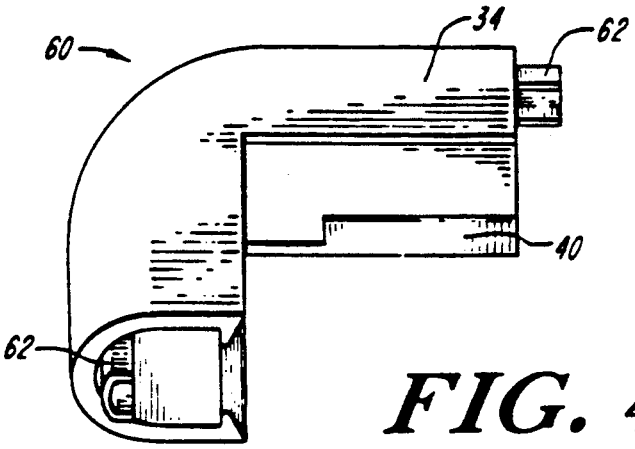
FIG. 4A is a side perspective view of the corner connector of the assembly of the invention.
Figure 4B:
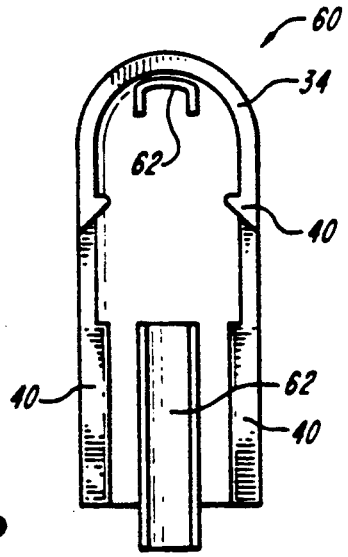
FIG. 4B is an end view of the corner connector of FIG. 4A.

As shown in FIGS. 4A–4B, the assembly may also comprise a corner connector 60 for interconnecting two assemblies 10 around a corner or edge of a structure. The corner connector 60 is of a construction similar to the protective trim member 30, having a top portion 32, a pair of opposing legs 34 and a pair of opposing latch ridges 40. The connector 60 interfits with a base member 12 in a manner similar to the interfitted protective trim member 30. The connector 60 may include a support protrusion 62 for providing support at straight, or butt-joint seams formed at the point where protective trim member 30 of assembly 10 abuts the connector 60.

Figure 5A:
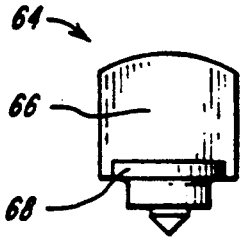
FIG. 5A is an end view of the seam support element of the assembly of the invention.
Figure 5B:
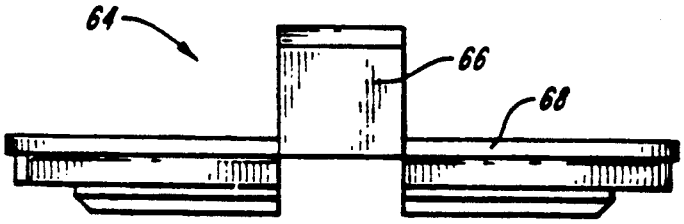
FIG. 5B is a side elevation view of the seam support element of FIG. 5A.
Figure 5C:
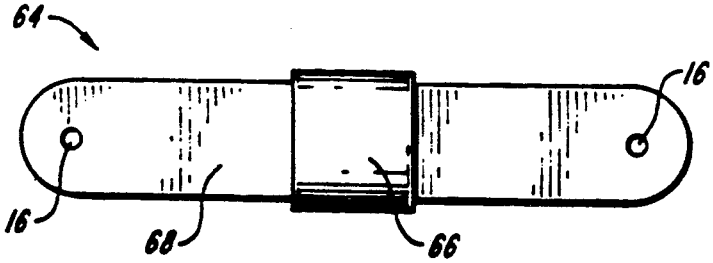
FIG. 5C is a top plan view of the seam support element of FIG. 5A.

A similar support-type structure for seams between two assemblies 10 is shown in FIGS. 5A–5C. When assemblies 10 are placed adjacent to one another, such as may occur on long surfaces, the place of the square, or butt-joint creates a seam. The point of the seam represents a structurally relatively weak point. A seam support element 64 may be positioned beneath the seam to provide additional structural support. The seam support element 64 is essentially comprised of a rigid arch member 66, which may be either solid or hollow in construction. A pair of laterally projecting flanges 68 provide lateral support and may be attached to base member 12 by attachment means 16. The rigid arch member 66 is positioned internally beneath a seam to provide structural support for the top portion 32 abutting trim member 30.

It should be noted that when two assemblies 10 are joined end to end, it is only necessary that the protective trim members 30 abut, not necessarily the base members 12. Thus, a gap may remain between the ends of two base members 12 of adjoining assemblies 10. The use of a seam support element 64 is important in such circumstances.

Figure 6A:
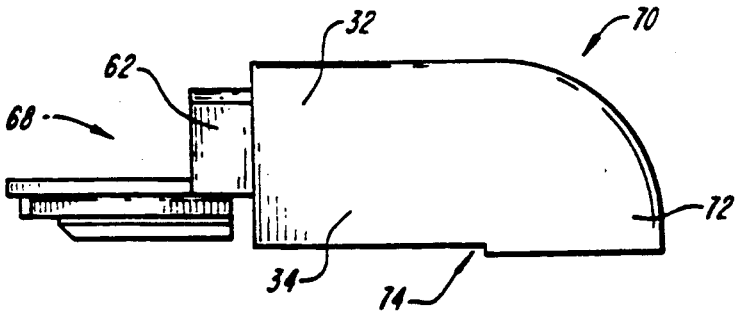
FIG. 6A is a side elevation view of the end cap of the assembly of the invention.
Figure 6B:
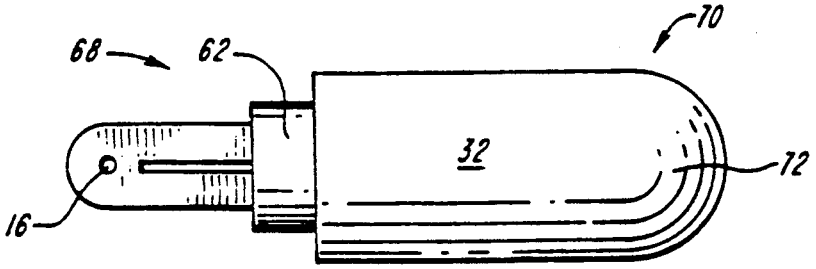
FIG. 6B is a top plan view of the end cap of FIG. 6A;.
Figure 6C:
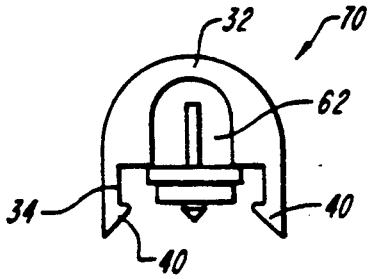
FIG. 6C is an end view of the end cap of FIG. 6A.

As shown in FIGS. 6A–6C, the assembly 10 may also comprise end caps 70 to provide protection and decorative continuity at the ends of the assemblies 10. The end caps 70 are similar in construction to the protective trim member 30 and the corner connector 60. Each end cap 70 comprises a top portion 32 having a downwardly tapered end 72, and an opposite square-cut end. The square-cut end is abutted to a protective trim member 30 of an assembly to form a square, or butt-joint. The tapered end 72 downwardly tapers to lie flush or parallel to the wall 50. Latch ridges 40 are formed from the legs 34 at a point of recess 74. The recess 74 allows the tapered end portion 72 to project over and cover the end of an underlying base member 12. A single laterally projecting flange 68 outwardly projects from the square-cut end of the end cap 70 to provide a means for attaching the end cap 70 to a base member 12. The end cap 70 also has a support protrusion 62 for supporting the overlying square or butt-joint formed by the abuttment of the end cap 70 to a protective trim member 30.

In operation, the protective strip assembly 10 absorbs impacts, and serves to protect the underlying structure or surface. Upon application of a force on the top portion 32 the protective trim member 30 moves in the direction of the force, transverse to the longitudinal axis. The downward movement forces the first sliding surface 38 downwardly slidably to move in contact with the first latch wall 18, while the friction caused by movement of the surfaces dissipates the remaining energy. The non-deformable nature of the trim member 30 enables the top portion 32 to substantially retain its shape after impact, by transferring all energy through legs 34.

Figure 7:
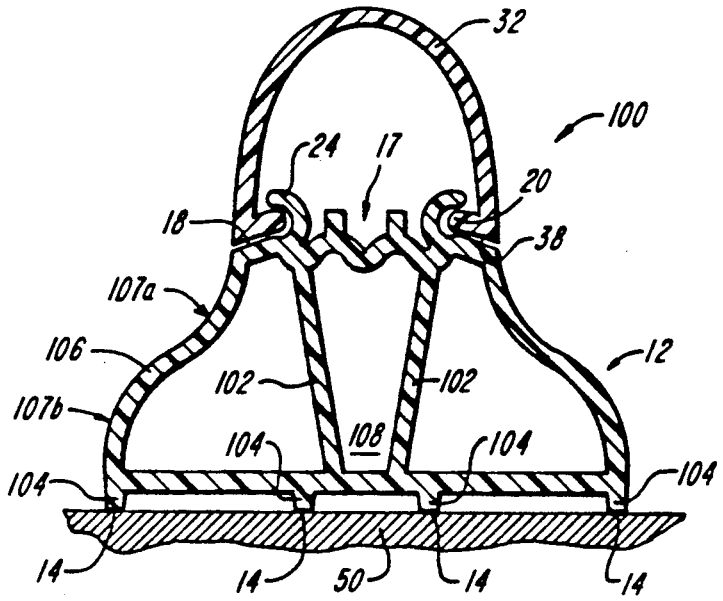
FIG. 7 is an end view of the base member of another embodiment of the present invention.

In an alternate embodiment, shown in cross-section in FIG. 7, the mounting surface 14 is spaced apart from the first sliding surface 38 to enable the top portion 32 to downwardly slide without encountering the wall 50. In that illustrated embodiment, the base member 12 includes side walls 106 which are generally concave in the upper portion **107*a* and generally convex in the lower portion 107*b*. Alternatively, the side walls 106 may have different configurations, e.g., squared, depending upon the placement requirements of the assembly 100**.

The illustrated embodiment of FIG. 7 may also include a series of support structures 102 to provide structural support to the assembly 100. The number of support structures 102 may vary depending upon the width of the base member 12 and the anticipated force to which the assembly 100 is to be subjected. As shown in FIG. 7, the support structures 102 may be angled in a manner to form a channel 108 which may serve as a guide when placing mounting means, e.g., screws or nails.

The mounting surface 14 of the illustrated embodiment may include two or more spurs 104 which project from the bottom of the base member. These spurs 104 form a mounting surface 14 spaced apart from the bottom of the base member to provide a buffer space to absorb force applied to the assembly 100. The number of spurs 104 may vary depending upon the width of the base member 100 and the anticipated force expected to affect the assembly, among other parameters.

Figure 8A:
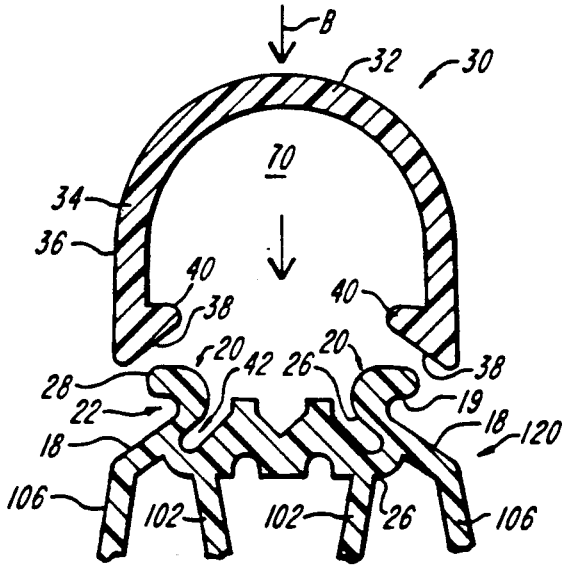
FIGS. 8A and 8B are cross-section exploded views of the trim connector portion of the embodiment of FIG. 7 shown before (FIG. 8A) and after (FIG. 8B) the base member and trim member are interfitted.
Figure 8B:
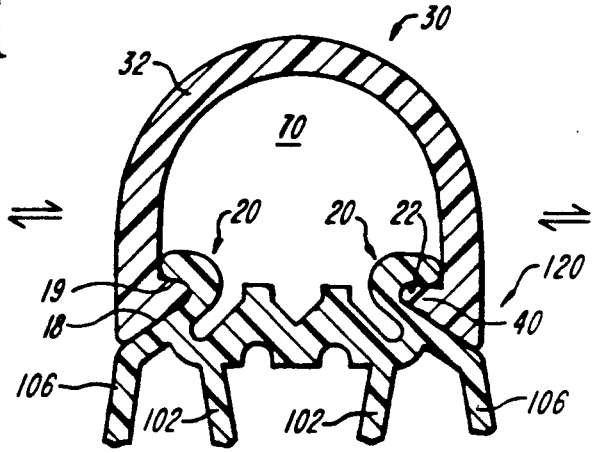

This embodiment, as best illustrated in FIGS. 8A and 8B, also includes a trim connector portion 120 for enabling the protective trim member 30 to interfit with the base member 12. The configuration of this illustrated trim connector portion 120 is similar to the configuration of the base member 12 in the previously described embodiment. In this embodiment, side walls 106 extend downwardly from the first latch walls 18 to spacially separate the mounting surface 14 from the latch element 20.

In one aspect, the material used for the trim member 30 is the same as the material used for manufacture of the base member 12. The preferred material is "rigid" polyvinyl chloride. In another aspect, the material used to manufacture the base element 12 is different from the material used to manufacture the trim member 30. Preferably, it is sufficiently resilient to permit the latch elements 20 to move upon application of installer applied force. This is necessary to enable the trim member 30 to be interfitted with the base member 12 once the base member 12 has been mounted upon a wall 50 closely adjacent an abutting structure.

The invention may be embodied in other specific forms.

What is claimed is:

1. A protective strip assembly comprising a) an elongate base member having a longitudinal axis and comprising:

i) a mounting element defining at least one mounting surface and a plurality of spurs forming said mounting surface;

ii) means for attaching said mounting element to a wall;

iii) a trim connector portion extending parallel to the longitudinal axis of the base member and spaced apart from said mounting surfaces and including an opposing pair of latch elements extending along said longitudinal axis and having an inwardly angled first latch wall substantially transverse to and extending along said longitudinal axis, said first latch wall extending from each of said latch elements;

iv) a web-like structure formed by at least one support member extending transverse to said longitudinal axis from said trim connector portion to said mounting element; and v) a side wall downwardly extending from each of said first latch walls; and b) a protective trim member in interlocking engagement with said base member at said trim connector portion, said member comprising:

i) an elongate top portion extending along said longitudinal axis, connected to a pair of opposed leg members, each of which is resiliently spreadable transverse to said axis; and ii) each of said leg members terminating in a latch ridge interfitting with each said latch element;

whereby application of force to said top portion of said trim member in a direction transverse to said longitudinal axis causes said time member to slide laterally and downwardly along said side wall thereby absorb said force.

2. The assembly of claim 1 wherein said base member further comprises an opposing pair of outwardly angled second latch walls extending along said longitudinal axis.

3. The assembly of claim 2 wherein said latch elements connect each of said first and second latch walls, and define an opposing pair of latch notches therebetween.

4. The assembly of claim 1 wherein each of said leg members further terminates in a first sliding surface extending upwardly and inwardly from an outer leg wall for sliding contact transverse to said longitudinal axis with said first latch wall.

5. The assembly of claim 1 wherein said base member further comprises an opposed pair of acutely inwardly angled latch flanges mounted on said opposing pair of latch elements and wherein said latch elements and latch flanges are resiliently deformable transverse to said axis, whereby said first sliding surface of each leg member of said trim member downwardly slidably contacts each said latch flange, and said latch elements deform inwardly transverse to said axis to interfit each of said latch ridges with each of said latch notches upon application of force to said protective trim member during assembly of said strip assembly.

6. The assembly of claim 5 wherein said base member further defines a pair of elongate opposed clefts each of which define a portion of an inner wall of said latch elements.

7. The assembly of claim 1 wherein said mounting element further comprises an internal groove surface extending along said longitudinal axis, said groove surface comprising a guiding groove extending along said longitudinal axis of said internal groove surface for guiding and receiving said attaching means.

8. The assembly of claim 1 wherein said base member comprises an extruded polymeric material.

9. The assembly of claim 1 wherein said trim member comprises a substantially rigid, laterally resilient polymeric material.

10. The assembly of claim 1 wherein said mounting element further comprises a plurality of parallel grooves extending along said longitudinal axis, whereby said grooves deform to conform with a wall upon mounting of said assembly to said wall.

11. The assembly of claim 1 wherein said side wall comprises an upper, concave portion and a lower, convex portion, said convex portion positioned between said concave portion and said mounting surface.

12. The assembly of claim 1 wherein said web-like structure comprises a plurality of said support members.

* * * * *